United States Patent [19]

Levine

[11] 4,199,915

[45] Apr. 29, 1980

[54] ANEROBIC ADHESIVE PACKAGE AND METHOD FOR THE PRODUCTION THEREOF

[76] Inventor: Harris D. Levine, 14 Upton Rd., Albany, N.Y. 12208

[21] Appl. No.: 943,622

[22] Filed: Sep. 19, 1978

[51] Int. Cl.[2] ..... B65B 1/16; B65B 3/10; B65B 3/16; B65B 3/26

[52] U.S. Cl. ..... 53/401; 53/434; 53/469; 53/473; 53/479; 141/48; 141/67

[58] Field of Search ..... 53/401, 403, 434, 459, 53/469, 467, 473, 479, 550, 567, 577; 141/48, 67, 47, 49, 91; 222/1, 399, 394

[56] References Cited

U.S. PATENT DOCUMENTS

| | | | |
|---|---|---|---|
| 2,430,995 | 11/1947 | Roos | 53/450 X |
| 2,530,400 | 11/1950 | Rado | 53/469 |
| 2,691,474 | 10/1954 | Olson | 53/479 |
| 2,764,862 | 10/1956 | Rado | 53/550 X |
| 2,870,583 | 1/1959 | Flax | 53/479 X |
| 2,936,816 | 5/1960 | Lang | 53/479 |
| 2,940,230 | 6/1960 | Flax | 53/479 |
| 2,958,169 | 11/1960 | Flax | 53/469 |
| 3,333,391 | 8/1967 | Horeth et al. | 53/479 X |
| 3,364,958 | 1/1968 | Sartor et al. | 141/48 X |
| 3,524,537 | 8/1970 | Winter | 206/229 |
| 3,561,186 | 2/1971 | Pickering | 53/469 X |
| 3,561,187 | 2/1971 | Rohnert et al. | 53/450 X |

FOREIGN PATENT DOCUMENTS

| | | | |
|---|---|---|---|
| 1027124 | 3/1958 | Fed. Rep. of Germany | 53/469 |

*Primary Examiner*—Horace M. Culver
*Attorney, Agent, or Firm*—Dann, Dorfman, Herrell and Skillman

[57] ABSTRACT

A method for producing sealed packages filled with fluid material wherein a limited amount of the material is delivered into a predetermined length of flexible, thermoplastic tubing, the major portion of which is wound on a primary reel, and the remainder of which is wound on a secondary reel. The amount is less than that required to completely fill the tubing, thus providing a slug of fluid material in the tubing on the primary reel and a vacant space in the tubing on the secondary reel. The amount of tubing on the secondary reel is calculated in advance to be equal in length to that portion of tubing required for the production of heat-sealed closures along the length of the tubing. The slug of material is displaced toward the secondary reel, thus creating a vacant space at the end of the tubing on the primary reel, and the tubing is rewound onto the primary reel. Then, starting with the filled end, the tubing is sequentially heat-sealed to provide spaced-apart closure portions along the entire length of the tubing, thereby producing individually sealed packages filled with the fluid material. In accordance with this method, which is especially suited for the packaging of anerobic adhesive material, the limited amount of material exactly fills the predetermined length of tubing. Packages produced in accordance with this method possess marked advantages over prior art packages for anerobic adhesive material.

9 Claims, 3 Drawing Figures

ANEROBIC ADHESIVE PACKAGE AND METHOD FOR THE PRODUCTION THEREOF

This invention relates to an improved method for the production of storable packages containing anerobic adhesive materials, or other substances which must be kept free from water vapor or other activating agents or contaminants, and to the package produced by the method. The present invention is particularly useful for the packaging of cyanoacrylate adhesives. As is well known, cyanoacrylate adhesives are applied as monomer and polymerize when pressed into a thin film between two adherends. Minute amounts of water vapor or other weak bases have a catalytic effect on the polymerization.

Cyanoacrylate adhesives are customarily packaged in containers made of thin metal which are provided with a small dispensing passage at one end, the opposite end being sealed by folding or rolling the metal on itself. The adhesive contained therein is ordinarily of such a quantity that it may be used at different times, and to that end, a screw cap is typically provided on the dispensing passage to permit reuse of the adhesive package. However, metal containers have not been entirely satisfactory for the packaging of cyanoacrylate adhesives for several reasons. One reason is that as the adhesive is dispensed, the metal container is ordinarily flattened out and bent or folded back upon itself by the user. This bending or folding often creates pin holes in the metal container which permit water vapor from the air to enter the container causing the adhesive to polymerize in the container, thus rendering it useless. Also, it is not uncommon that through inadvertence or otherwise, the screw cap is left off of the container for a period of time sufficient to allow hardening of the adhesive in the dispensing passage, thus making reuse of the package impossible.

The above-described shortcomings of metal containers for cyanoacrylate adhesives may be overcome by making the container of a flexible, plastic material, and filling it with only so much of the adhesive as is required for the job at hand. Although such containers are not unknown in the prior art, for example, see U.S. Pat. No. 3,524,537, the method by which they are produced is not particularly efficient. Typically, the prior art method involves cutting a predetermined length of tubing from stock, hermetically sealing the tubing at one end so as to provide a discharge orifice of reduced crossed section relative to the remainder of the tubing, filling the tubing at its open, opposite end with cyanoacrylate adhesive material, and then hermetically sealing the opposite end of the tubing.

The present invention, by contrast, provides an efficient and effective method for producing cyanoacrylate adhesive packages which involves the steps of filling a given length of flexible, transparent, vapor-impervious, thermoplastic tubing with a predetermined amount of cyanoacrylate adhesive material, and sequentially heat sealing the tubing to provide adjacent spaced-apart closure portions therein, thus producing individually sealed packages filled with cyanoacrylate adhesive material. While this rather broad description of the invention may appear at first blush to be similar to prior art methods for producing sealed containers filled with fluid materials, it is not believed that this particular method, the steps of which will be set forth in detail hereinbelow, has ever before been used in the packaging of fluid materials, especially anerobic materials, such as cyanoacrylate adhesives.

The primary reason why the well-known prior art methods for heat sealing plastic tubing containing fluid materials have not been successfully applied to the packaging of cyanoacrylate adhesive materials is due to the serious problems which must be overcome in order to operate the method in a reliable and efficient manner. For example, it is well known that cyanoacrylate adhesives have the capability of forming a tenacious bond to a wide variety of substrates, including human skin. This capability presents a serious hazard to the operators of the packaging machinery if it becomes necessary to shut down the machinery in order to clean up an accidental spill, or the like. Spillage of the adhesive may also have a deleterious effect of the packaging machinery itself and other property. The likelihood of such accidents would be substantial using prior art methods wherein the plastic tubing is completely filled with adhesive material prior to heat sealing, since the pressure build-up in the tubing caused by the application of the heat-sealing apparatus thereto may perforate the hot, semi-liquid seal just formed, or rupture the tubing behind the seal. In addition to the safety hazard presented, such accidents also result in economic loss, due to the loss of the adhesive material and the ruptured tubing, both of which are relatively expensive materials. Shutdown of the packaging machinery while the problem is being rectified also contributes to the economic loss.

Another problem encountered in developing the present invention was the selection of suitable tubing material, i.e., one having the necessary flexibility and vapor-imperviousness required of a container for cyanoacrylate adhesives, and the ability to resist sticking to the heated jaws of the sealing apparatus. Sticking often occurs when using polyethylene tubing, for example. It would thus be desirable to provide a cyanoacrylate adhesive package and method for the production thereof which avoid the problems inherent in the prior art packages and methods.

Accordingly, it is an object of the present invention to provide a method for packaging anerobic adhesive material, including a heat-sealing step, which does not cause hazardous pressure build-up in the tubing, or damage the tubing during processing.

Another object of this invention is to provide an efficient method for packaging anerobic adhesive materials wherein a measured amount of adhesive material is delivered to a predetermined length of plastic tubing so as to exactly fill the tubing after the desired number of spaced-apart heatsealed closure portions have been provided along the length of the tubing.

A further object of this invention is to provide an improved package for anerobic adhesive materials comprising an elongated, hollow, flexible, plastic tube, the bore of which is filled with the adhesive, and the ends of which are hermetically sealed to encapsulate the adhesive in an inert, gas-impervious envelope.

The above objects have been achieved in accordance with the method of the present invention. In the first step of the method, a predetermined length of flexible, transparent, vapor-impervious, thermoplastic tubing is wound onto a primary or first reel. The tubing is open at both ends, one end thereof being retained on the primary reel. Next, a relatively small segment of the tubing, including the other end thereof, is wound onto a secondary reel. The anerobic adhesive material is then delivered under pressure into the tubing through said one end thereof until the adhesive material reaches a point between the two reels. At that time, delivery of the adhesive material is halted, thus producing a slug of adhesive material that completely fills the tubing wound on the primary reel. In the next step, the slug of adhesive material is displaced toward the second reel by introducing gas under pressure into said one end of the tubing. Displacement is continued until the adhesive material fills the transferred segment and creates a vacant space extending from said one end of the tubing toward the second reel, the vacant space being equal in volume to said filled transferred segment. Next, all the tubing is rewound onto the primary reel. Finally, the tubing is unwound from the reel starting with the filled end, and spaced-apart portions thereof are heat-sealed to provide closures along the entire length of the tubing, thus providing individually sealed packages filled with anerobic adhesive material.

By carrying out the invention according to the steps outlined above, the possibility of rupturing the tubing during heat-sealing is minimized due to the provision of the vacant space in the tubing which permits the adhesive material to flow away from the heat-sealed closure portion and toward the vacant space during the heat-sealing operation. Moreover, since the percentage of a given length of tubing required for the heat-sealed closure portions can be calculated in advance, that precise percentage of tubing may be transferred onto the secondary reel, and the requisite amount of adhesive material delivered into the tubing to exactly fill the tubing after the desired number of spaced-apart, heat-sealed closure portions have been provided along the length of the tubing.

The novel features and advantages of the present invention will be apparent to those skilled in the art from a reading of the following detailed description in conjunction with the accompanying drawings, in which.

Figure 1:
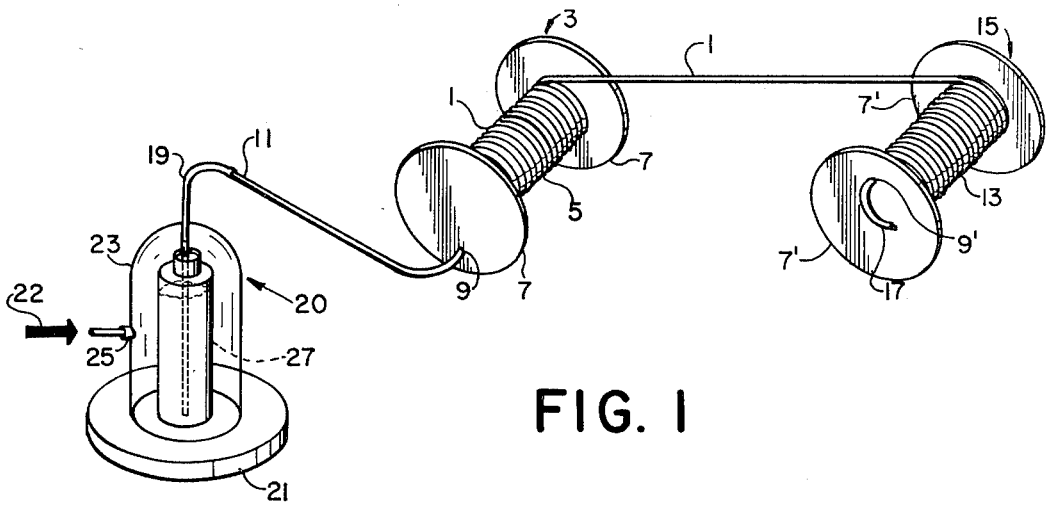
FIG. 1 is a perspective view of the apparatus employed in filling the tubing with anerobic adhesive material.

FIG. 1 shows the general arrangement of tubing 1, primary reel 3, secondary reel 15, and pressure vessel 20 employed during the tubing filling operation. Initially, a predetermined length of flexible, transparent, thermoplastic tubing 1 is provided on a primary or first reel generally designated 3. Reel 3 preferably comprises a spool 5 having a pair of axially spaced radial flanges 7, the tubing 1 being wound therebetween in successive overlapping convolutions. One flange may be provided with an opening 9 through which one end 11 of the tubing 1 may extend outwardly from the first convolution to render it accessible for connection to the adhesive delivery apparatus which will be described in greater detail hereinbelow.

As shown in FIG. 1, a segment 13 comprising the outer convolutions of the predetermined length of tubing 1 is transferred to a secondary reel generally designated 15, the structure of which corresponds generally to reel 3, described above. The length of segment 13 is generally less than 50% of the predetermined length of tubing 1 and preferably ranges from about 10% to about 30% thereof. The ends 11 and 17 of the tubing should be secured to the reels 3 and 15, respectively, to keep the convolutions of the tubing intact during the transfer step, and during subsequent processing as well. This may be accomplished, for example, by passing the ends 11 and 17 of the tubing through openings 9 and 9' and taping them in place on the reel flanges 7 and 7'.

The end 11 of the tubing associated with reel 3 is open to allow attachment to the feed line 19 of a pressure vessel, generally designated 20. The pressure vessel 20 comprises a base plate 21 and a cover 23, which is provided with a port 25 for the introduction of pressurized gas. Inside pressure vessel 20 is an open container 27 of anerobic adhesive material, for example, a cyanoacrylate adhesive. Feed line 19 extends into container 27 to a point adjacent the bottom thereof. The pressure vessel 20 should be capable of withstanding up to 125 Psig for the period of use.

As a preliminary step to the filling operation, an inert gas free from moisture and particulate matter (source not shown) is passed through the tubing, for example by being introduced under pressure at end 11 of tubing 1 before or after the predetermined length of tubing 1 is arranged on reels 3 and 15, as shown in FIG. 1, in order to insure that no water vapor is entrapped in the tubing.

With respect to the actual filling operation, end 11 of tubing 1 is connected to feed line 19 of pressure vessel 20 and pressurized gas (source indicated by arrow 22) is introduced through port 25 into pressure vessel 20 causing the anerobic adhesive material to flow from container 27 into tubing 1. The gas pressure is maintained until the anerobic material reaches a point between reels 3 and 15. Since the tubing is transparent, the occurrence of this event can be determined visually. When the anerobic material reaches the designated point, the source of pressure at 22 is deactivated and the end 11 of tubing 1 is disconnected from feed line 19, halting the flow of the anerobic material to tubing 1, thereby providing a slug of adhesive material completely filling that portion of tubing 1 on reel 3. Thereupon the aforementioned inert gas is again introduced into end 11 of tubing 1, this time in order to displace the slug of anerobic adhesive material in the tubing toward segment 13. Concurrently the gas source is connected to the feed line 19 to blow any material retained in the tube 19 back into the container 27. As used herein, the term "slug" refers to a unitary mass of anerobic adhesive material contained within tubing 1, which remains substantially intact when caused to flow by introducing gas under pressure into the tubing. The gas pressure is maintained until the adhesive material fills segment 13 on reel 15 and a vacant space is created extending from end 11 of tubing 2 toward reel 15, the vacant space being approximately equal in volume to filled segment 13. The ends 11 and 17 of tubing 1 are then plugged and segment 13 is rewound onto reel 3, the filling operation having been completed.

It should be noted that segment 13 may be rewound onto reel 3 between the delivery and the displacement steps, or rewinding may be delayed until after completion of the displacement step.

The gas pressure used for delivery of the anerobic adhesive material and for displacement of the adhesive plug requires certain adjustments during the filling operation. Thus, during delivery of the anerobic adhesive material, the gas pressure may vary from 10 to 75 psig, but should be regulated from about 30 to about 50 psig. The pressure should be maintained within the latter range so that the operator has adequate control over the filling operation to avoid overfill and spillage. However, for displacing the slug of adhesive material from tubing 2 on reel 3 to segment 13, the gas pressure should be reduced to about 5 to about 10 psig. The gas pressure employed when drying the tubing may range from about 10 to about 40 psig.

From a practical standpoint, the gaseous medium of choice for drying the tubing and for displacing the slug of adhesive material is dessicated air. However, dry nitrogen or other inert gases may also be employed.

Figure 2:
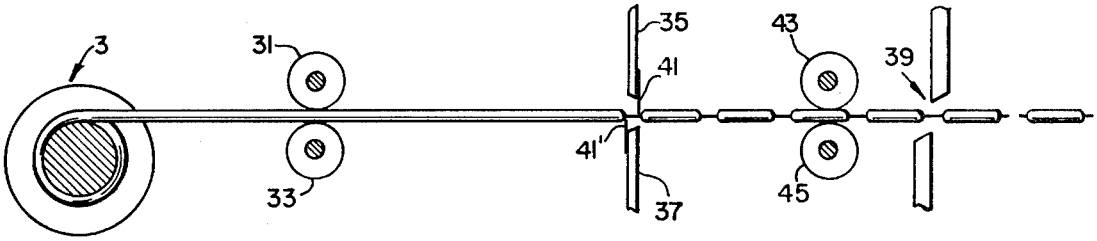
FIG. 2 is a schematic view of the heat-sealing apparatus used to carry out the method of the present invention.

FIG. 2 is a schematic representation of the apparatus used in hermetically sealing the filled tubing provided in the manner set forth above. The tubing 1 is unwound from reel 3, is drawn through drive roll 31 and pinch roll 33, frictional pressure being provided by the latter to minimize slippage, and is hermetically-sealed by sealer jaws 35 and 37 to provide spaced-apart closure portions along the length of the tubing. Hermetic sealing can be carried out either thermally, ultrasonically or dielectrically, the details of such techniques being well known to those skilled in the art. The anerobic-adhesive-containing packages are produced as a continuous string and may be cut apart for packaging either individually or in a series of two or more, by manual methods or by mechanical means generally designated 39.

The sealer jaws 35 and 37 are biased, as shown in FIG. 2, which causes the adhesive material to flow toward the aforementioned vacant space and away from each sealed closure portion as it is formed, thus further attenuating the possibility of rupturing the tubing. In order to obtain a proper seal, mechanical alignment of sealer jaws 35 and 37 is essential. Also, the movement of sealer jaw 35 should be regulated at a slow pace, sealer jaw 37 being held in a fixed position, to avoid pressure buildup in the adhesive material since the previous seal may still be in a semi-liquid state and can rupture if the subsequent sealing operation causes a pressure buildup in the tubing. The seal pressure should be from about 30 to about 60 psig.

With respect to the temperature of the sealer jaws 35 and 37, it has been found that the lower jaw radiates heat by conduction to the upper jaw and must be controlled to have a slightly higher temperature than the upper jaw. By appropriate adjustment, both jaws can be brought to an operating temperature that will provide a homogenous seal without sticking.

When sealer jaw 35 lifts, it is also necessary to lift the tubing away from the jaw faces to avoid distortion of the seal or tearing of the tubing because of the fragile nature of the semi-fluid seal. This is accomplished by means of providing each sealer jaw with a stripper 41 and 41'. The bottom stripper 41, mounted on sealer jaw 35, pulls the tubing away from the lower sealer jaw 37, while the top stripper 41', mounted on the sealer jaw 37, pulls the tubing away from the upper sealer jaw 35.

Figure 3:
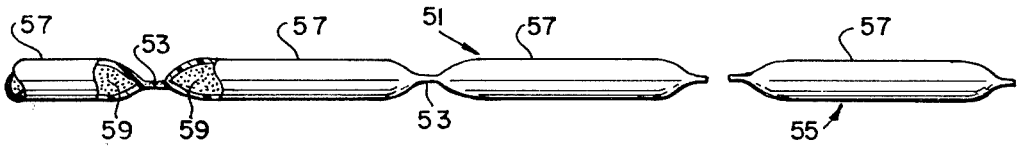
FIG. 3 is a side elevation view with a portion broken away of anerobic-adhesive-containing packages produced in accordance with the present invention.

FIG. 3 is a side elevation view of an anerobic-adhesive-containing package, generally designated 51, produced in accordance with the present invention, showing the adjacent, spaced-apart closure portions 53 along a length of tubing, which provide individually sealed packages filled with anerobic adhesive material. As shown in FIG. 3, the package comprises a container 55 consisting of an elongated, hollow tube 57 having the requisite characteristics mentioned above and anerobic adhesive material 49, such as a cyanoacrylate adhesive, filling the bore of the tube, which is collapsed and heat-sealed at 53 to encapsulate the adhesive material in an inert, vapor-impervious envelope.

Packages of anerobic adhesive material produced in accordance with the present invention possess certain advantages as compared with metal packages of the prior art. Thus, by employing small bore tubing, the length of which may vary depending on the nature of the mending job contemplated, accidental spills and hazards attendant thereupon, such as the binding together of two surfaces of skin, are largely avoided because of the limited volume of adhesive available for use. Should additional adhesive be required, however, one merely opens another package.

In order to apply the adhesive material, both ends of the package may be severed so that the adhesive may flow out by capillary action when in contact with the substrate to be bonded, or only one end may be severed, in which case the adhesive material may either be forced out of the package by the application of pressure on the walls thereof, or the open end of the package may be touched to the substrate to be bonded, applying only a "microdrop" thereto. Numerous bonds of the latter type can be made with a single package where a minimum amount of adhesive is required. When one end of the package is severed, only the adhesive material in the vicinity of the opening will harden. Thus, by further severing the hardened portion, the remainder of the adhesive in the package can be used. Thus, the package of the present invention has a distinct advantage over metal package for anerobic adhesive material, which are rendered useless when the adhesive hardens in the dispensing passage thereof.

As used herein, the expression "cyanoacrylate adhesive" is intended to encompass a wide variety of cyanoacrylate monomers, for example, alkyl-2-cyanoacrylates, including metal-, ethyl-, propyl-, isopropyl-, butyl-, isobutyl-, pentyl-, hexyl-, heptyl-, octyl-, nonyl-, and decyl- 2-cyanoacrylates, and flurolalkyl-2-cyanoacrylates, such as trifluroisopropyl-2-cyanoacrylate.

The contents of the package may exist in a variety of formulations. For example, the package may contain substantially pure monomer. Alternatively, the contents may comprise monomer to which has been added a thickening agent, polymerization inhibitor, stabilizer, plasticizer or other additive well known to those skilled in the art.

As mentioned previously, the container must be a transparent, thermoplastic tubing having good flexibility. More importantly, however, it must be sufficiently hydrophobic so as to totally inhibit the passage of water in any form. A container material which has been found to possess all of these characteristics, and which is the preferred container material for use in accordance with this invention, is fluorinated ethylene-propylene resin (FEP resin). FEP resin is a copolymer of tetrafluorethylene and hexafluoropropylene having properties similar to those of polytetrafluorethylene (TEFLON ®). The remarkable chemical stability of FEP resin enables it to resist staining, discoloration or deterioration of the package. FEP resin tubing is commercially available in wall thicknesses ranging from about 0.006 inches to about 0.045 inches, with inside diameters ranging from about 0.12 inches to about 0.875 inches. Since a wide range of tubing lengths are also available, the package volume is a matter of choice. Although polyethylene can also be used as a container material for cyanoacrylate adhesives, it permits some water penetration upon prolonged storage and is therefore not as effective as FEP resin.

The package of the present invention is particularly useful for applying small amounts of cyanoacrylate adhesive, on the order of about 3 $mm^3$, suitable for repairing split fingernails, as well as for other small mending jobs.

While a particular embodiment of the present invention has been illustrated and described herein, it is not intended to limit the invention to such disclosure, but changes and/or additions may be made therein and thereto without departing from the invention as set forth in the following claims.

I claim:

1. A method for producing sealed packages filled with anerobic adhesive material comprising the steps of winding a predetermined length of flexible, transparent, vapor-impervious, thermoplastic tubing onto a first reel, said tubing being open at both ends, the first of said ends being retained in association with said first reel; transferring a segment of said tubing, not exceeding fifty percent thereof and including the other of said ends, onto a second reel; delivering said anerobic adhesive material under pressure into said tubing through said first end thereof until said anerobic adhesive material reaches a point between said first reel and said second reel; halting delivery of said anerobic adhesive material to provide a slug of material completely filling the tubing on said first reel; displacing said slug of material toward said second reel by introducing gas under pressure into said first end of said tubing and continuing said displacement until the material fills said segment on said second reel and creates a vacant space approximately equal in volume to said filled segment, said vacant space extending from said first end of said tubing toward the second reel; transferring said segment from said second reel back onto said first reel; unwinding said tubing from said reel and sequentially heat-sealing spaced-apart portions of said tubing to provide closures in said tubing starting at said other end thereof, so as to cause said anerobic adhesive material displaced by said heat-sealed closure portions to flow away from said heat-sealed closure portions and toward said vacant space, adjacent spaced-apart closure portions of said tubing thereby producing individually sealed packages filled with anerobic adhesive material.

2. A method according to claim 1 wherein first reel comprises a spool having a pair of axially spaced radial flanges, said tubing being wound on said reel between said flanges in successive overlapping convolutions, the first end of said tubing being open and retained in association with said first reel, passing outwardly from said first convolution through one of said pair of flanges.

3. A method according to claim 2 wherein said transferred segment of said tubing consists of the outer convolutions of the predetermined length of tubing wound on said first reel, said segment being transferred back to said first reel after delivery of said anerobic adhesive material to said first reel is halted and before displacing said slug of material.

4. A method according to claim 2 wherein said transferred segment of said tubing consists of the outer convolutions of the predetermined length of tubing wound on said first reel, said segment being transferred back to said first reel after displacing said slug of material.

5. A method according to claim 1 wherein said segment comprises from about 10% to about 30% of said tubing.

6. A method according to claim 1 wherein said adhesive material comprises a cyanoacrylate monomer and said tubing comprises a fluorinated ethylene-propylene resin.

7. A method according to claim 6, including the preliminary step of drying the bore of said predetermined length of tubing by passing a gaseous drying medium through said bore prior to delivering fluid material thereto, said gas used for displacing said slug of material also being a gaseous drying medium.

8. A method according to claim 7 wherein said gaseous drying medium is dessicated air.

9. A method for producing sealed packages filled with fluid material comprising the steps of winding a predetermined length of flexible, thermoplastic tubing having first and second ends onto a first reel, said reel comprising a spool having a pair of axially-spaced radial flanges, said tubing being wound on said reel between said flanges in successive overlapping convolutions, said first end of said tubing being open and retained in association with said first reel, passing outwardly from said first convolution through one of said pair of flanges; transferring a segment comprising from about 10% to about 30% of said tubing and including the second of said ends onto a second reel; delivering said fluid material under pressure into said tubing through said first end thereof until said fluid material reaches a point between said first reel and said second reel; halting delivery of said fluid material to provide a slug of said fluid material completely filling the tubing on said first reel; displacing said slug of material toward said second reel by introducing gas under pressure into said first end of said tubing and continuing said displacement until the material fills said segment on said second reel and creates a vacant space approximately equal in volume to said filled segment, said vacant space extending from said first end of said tubing toward said second reel; transferring said segment from said second reel back onto said first reel; unwinding said tubing from said reel and sequentially heat-sealing spaced-apart portions of said tubing to provide closures in said tubing starting at said second end thereof, so as to cause said fluid material displaced by said heat-sealed closure portions to flow away from said heat-sealed closure portions and toward said vacant space, adjacent spaced-apart closure portions of said tubing thereby producing individually sealed packages filled with fluid material.

* * * * *